US010343029B2

(12) United States Patent
Takeuchi

(10) Patent No.: US 10,343,029 B2
(45) Date of Patent: Jul. 9, 2019

(54) GOLF CLUB

(71) Applicant: SUMITOMO RUBBER INDUSTRIES, LTD., Hyogo (JP)

(72) Inventor: Hiroyuki Takeuchi, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/057,252

(22) Filed: Aug. 7, 2018

(65) Prior Publication Data

US 2019/0060715 A1 Feb. 28, 2019

(30) Foreign Application Priority Data

Aug. 31, 2017 (JP) ..... 2017-166630

(51) Int. Cl.

| | |
|---|---|
| ***A63B 53/02*** | (2015.01) |
| *A63B 53/04* | (2015.01) |
| *A63B 102/32* | (2015.01) |
| *A63B 53/00* | (2015.01) |

(52) U.S. Cl.

CPC ..... *A63B 53/02* (2013.01); *A63B 53/007* (2013.01); *A63B 53/047* (2013.01); *A63B 53/0466* (2013.01); *A63B 2102/32* (2015.10)

(58) Field of Classification Search

CPC ..... A63B 53/02; A63B 53/047; A63B 53/007; A63B 53/0466; A63B 2102/32

See application file for complete search history.

(56) References Cited

U.S. PATENT DOCUMENTS

| | | | | | |
|---|---|---|---|---|---|
| 1,983,069 | A * | 12/1934 | Cowdery | A63B 53/02 | 473/310 |
| 4,948,132 | A * | 8/1990 | Wharton | A63B 53/06 | 473/246 |
| 5,433,442 | A * | 7/1995 | Walker | A63B 53/02 | 473/239 |
| 2009/0325727 | A1* | 12/2009 | Takeuchi | A63B 53/02 | 473/305 |
| 2011/0319187 | A1* | 12/2011 | Chou | A63B 53/02 | 473/310 |

FOREIGN PATENT DOCUMENTS

JP 2010-005113 A 1/2010

* cited by examiner

*Primary Examiner* — John E Simms, Jr.
(74) *Attorney, Agent, or Firm* — Greenblum & Bernstein, P.L.C.

(57) ABSTRACT

A golf club includes a shaft-insertion hole, a shaft inserted to the shaft-insertion hole, and a ferrule attached to the shaft. The ferrule includes an upper part exposed to the outside, and a lower part located between the shaft-insertion hole and the shaft. The lower part of the ferrule includes at least one through hole. The through hole includes a chamfered portion on an outer surface side of the lower part. Preferably, the lower part includes a plurality of through holes. The through holes may be provided at respective four or more positions in a circumferential direction of the lower part. The through hole may have a minimum hole area of greater than or equal to 3 $mm^2$ and less than or equal to 12 $mm^2$.

12 Claims, 13 Drawing Sheets

GOLF CLUB

This application claims priority on Patent Application No. 2017-166630 filed in JAPAN on Aug. 31, 2017. The entire contents of this Japanese Patent Application are hereby incorporated by reference.

BACKGROUND OF THE INVENTION

Field of the Invention

The present invention relates to a golf club including a ferrule.

Description of the Related Art

A golf club usually has a ferrule. Typically, the ferrule is provided adjacent to an upper end surface of a hosel.

JP2010-5113 (US2009/0325727) discloses a ferrule having a base part interposed between a larger-diameter part of a hosel hole and a shaft.

SUMMARY OF THE INVENTION

As a golf club is repeatedly used, a ferrule might move toward a grip side. This phenomenon is also referred to as ferrule floating. A shaft bend upon hitting. The bending of the shaft also occurs inside the ferrule. The repeated bendings of the shaft inside the ferrule is considered as the cause of the ferrule floating.

It is an object of the present disclosure to provide a golf club capable of suppressing the ferrule floating.

In one aspect, a golf club includes a shaft-insertion hole, a shaft inserted to the shaft-insertion hole and adhered to the shaft-insertion hole by an adhesive, and a ferrule attached to the shaft. The ferrule may include an upper part exposed to the outside and a lower part located between the shaft-insertion hole and the shaft. The lower part may include at least one through hole. The through hole may include a chamfered portion on an outer-surface side of the lower part.

In another aspect, the at least one through hole of the lower part may comprise a plurality of through holes. The through holes may be provided at respective three or more positions in a circumferential direction of the lower part.

In another aspect, the though hole may have a minimum hole area of 3 $mm^2$ or greater and 12 $mm^2$ or less.

In another aspect, the through hole may have a minimum axial-direction width M1 and a minimum circumferential-direction width M2. The minimum circumferential-direction width M2 may be equal to the minimum axial-direction width M1, or may be smaller than the minimum axial-direction width M1.

BRIEF DESCRIPTION OF THE DRAWINGS

FIG. 3 is the sectional view of the phase in which a through hole of the ferrule is present;

FIG. 9 is also a sectional view showing a method for measuring a ferrule-shaft adhesive strength;

DESCRIPTION OF THE PREFERRED EMBODIMENTS

The following will describe embodiments in detail with appropriate reference to the drawings.

In the present application, terms indicating "upper" such as "upper part" and "upper side" are used. In the present application, terms indicating "lower" such as "lower part" and "lower side" are also used. In the present application, the "upper" means a butt-end side of a shaft, or a grip side. The "lower" means a tip-end side of the shaft, or a sole side of a head. Unless otherwise described, in the present application, the term "axial direction" means the axial direction of a ferrule, the term "circumferential direction" means the circumferential direction of the ferrule, and the term "radial direction" means the radial direction of the ferrule.

Figure 1:
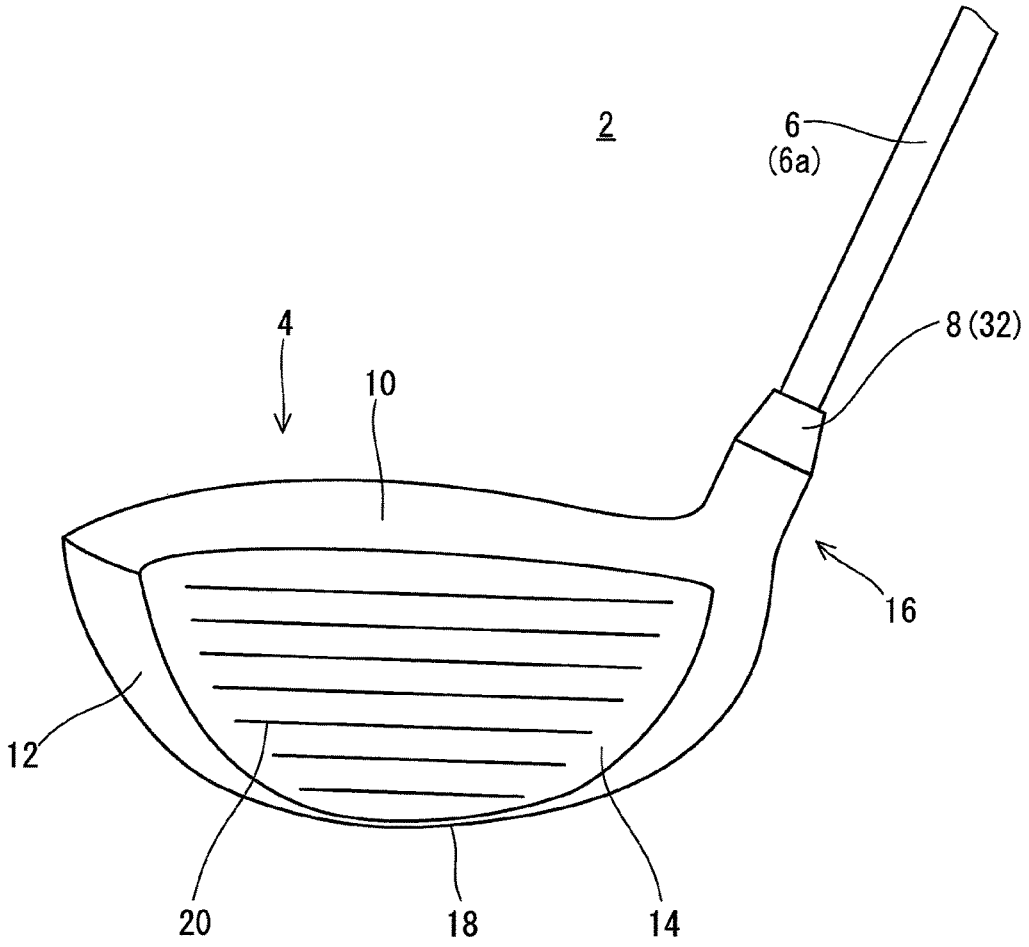
FIG. 1 shows a golf club according to one embodiment.
Figure 2:
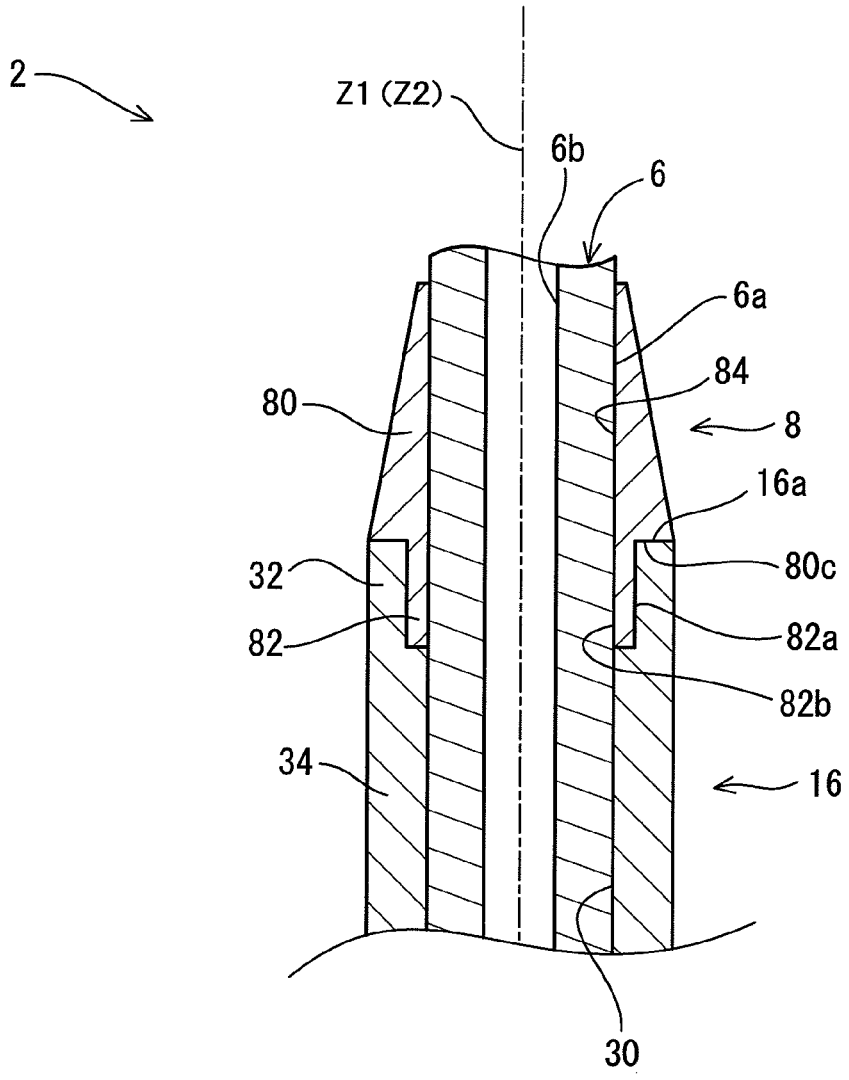
FIG. 2 is a sectional view of a vicinity of a ferrule in the golf club of FIG. 1.
Figure 3:
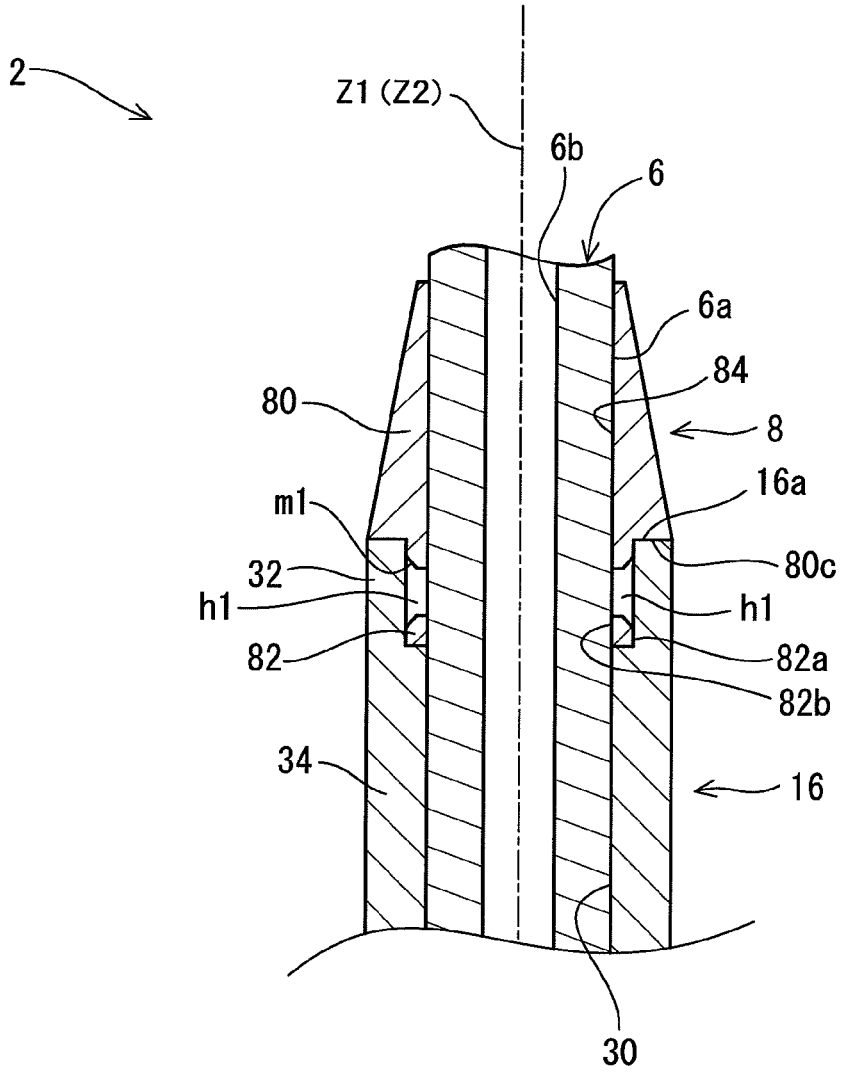
FIG. 3 is a sectional view similar to FIG. 2, a phase of the section in FIG. 3 differs from a phase of the section in FIG. 2.

FIG. 1 shows a golf club 2 according to a first embodiment. FIG. 1 shows only a vicinity of a head. FIG. 2 and FIG. 3 are sectional views of the golf club 2 in the vicinity of a hosel. FIG. 2 and FIG. 3 are the sectional views taken along a ferrule axis line Z1. The ferrule axis line Z1 coincides with a shaft axis line Z2. A phase of the section of FIG. 2 is different from that of FIG. 3.

The golf club 2 includes a head 4, a shaft 6, and a ferrule 8. The head 4 is attached to a tip-end portion of the shaft 6. Although not shown in the drawings, a grip is attached to a butt-end portion of the shaft 6. The shaft 6 has a tubular shape. The shaft 6 has an outer surface 6*a* that is a circumferential surface. The shaft 6 has an inner surface 6*b* that is a circumferential surface.

The head 4 is a wood type golf club head. The head 4 includes a crown 10, a skirt (side) 12, a face 14, a hosel 16, and a sole 18. The head 4 is hollow. Face lines 20 are provided on the face 14. The type of the head 4 is not limited. The head 4 may be a hybrid type head, an iron type head, or a putter type head.

The hosel 16 includes a shaft-insertion hole 30. In the present embodiment, the hosel 16 of the head 4 includes the shaft-insertion hole 30. A sleeve may be attached to the tip end of the shaft, and the sleeve may include the shaft-insertion hole. The sleeve can be screwed to the head.

As shown in FIG. 2 and FIG. 3, the shaft-insertion hole 30 has a first portion 32 and a second portion 34. The first portion 32 is located on the upper side of the second portion 34. The first portion 32 is coaxial with the second portion 34. The upper end surface of the first portion 32 is an end surface 16*a* of the hosel 16.

The first portion 32 constitutes an upper end part of the shaft-insertion hole 30. The first portion 32 has an inner diameter greater than that of the second portion 34.

Although not shown in the drawings, an adhesive layer is present between the shaft 6 and the shaft-insertion hole 30. The shaft 6 is adhered to the shaft-insertion hole 30 by an adhesive. The adhesive layer is present between the shaft 6 and the second portion 34. The shaft 6 is adhered to the second portion 34 by an adhesive.

The ferrule 8 includes an upper part 80 and a lower part 82. The upper part 80 is exposed to the outside. The lower part 82 is located between the shaft-insertion hole 30 and the shaft 6. More specifically, the lower part 82 is located between the first portion 32 of the shaft-insertion hole 30 and the outer surface 6*a* of the shaft 6.

As shown in FIG. 3, the lower part 82 includes a through hole h1. The through hole h1 penetrates the lower part 82. The through hole h1 extends from an outer surface 82*a* of the lower part 82 to an inner surface 82*b* of the lower part 82.

A hardened adhesive is present inside the through hole h1, although not shown in FIG. 3. The adhesive penetrates the lower part 82. The adhesive which is present inside the through hole h1 is also referred to as an intra-hole adhesive. The intra-hole adhesive is brought into contact with the outer surface of the shaft 6. The intra-hole adhesive is brought into contact with the inner surface of the shaft-insertion hole 30 (first portion 32). The outer surface of the shaft 6 and the inner surface of the shaft-insertion hole 30 are connected by the intra-hole adhesive. The outer surface of the shaft 6 and the inner surface of the first portion 32 are connected by the intra-hole adhesive.

Figure 4:
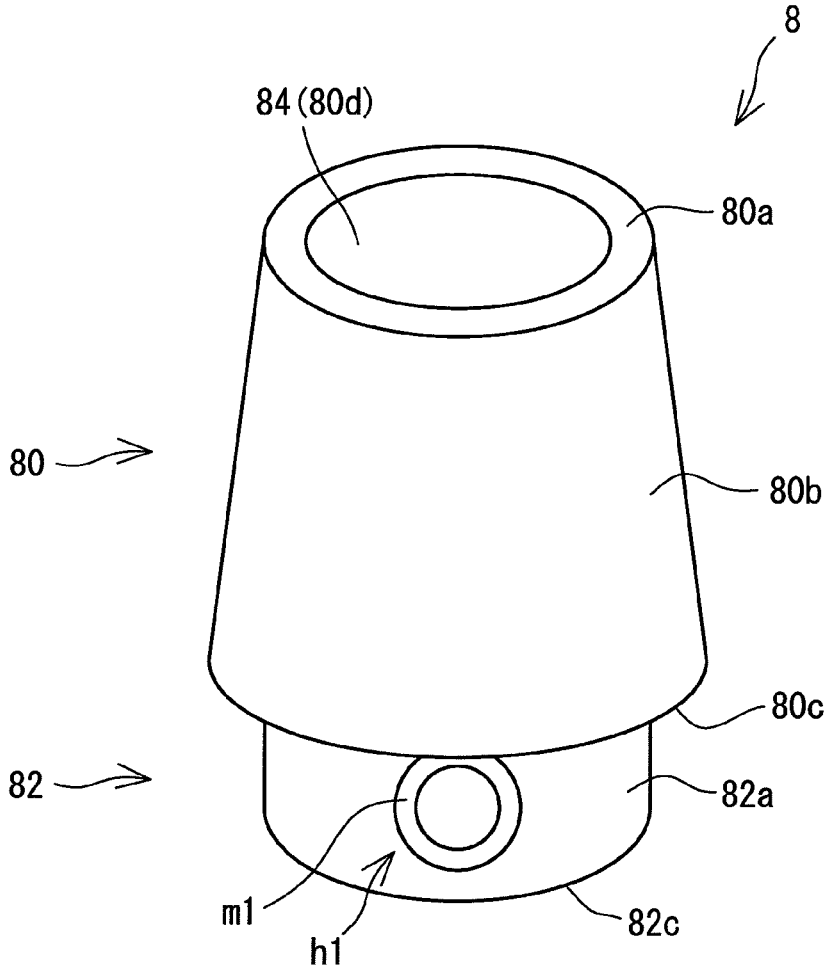
FIG. 4 is a perspective view of the ferrule.
Figure 5:
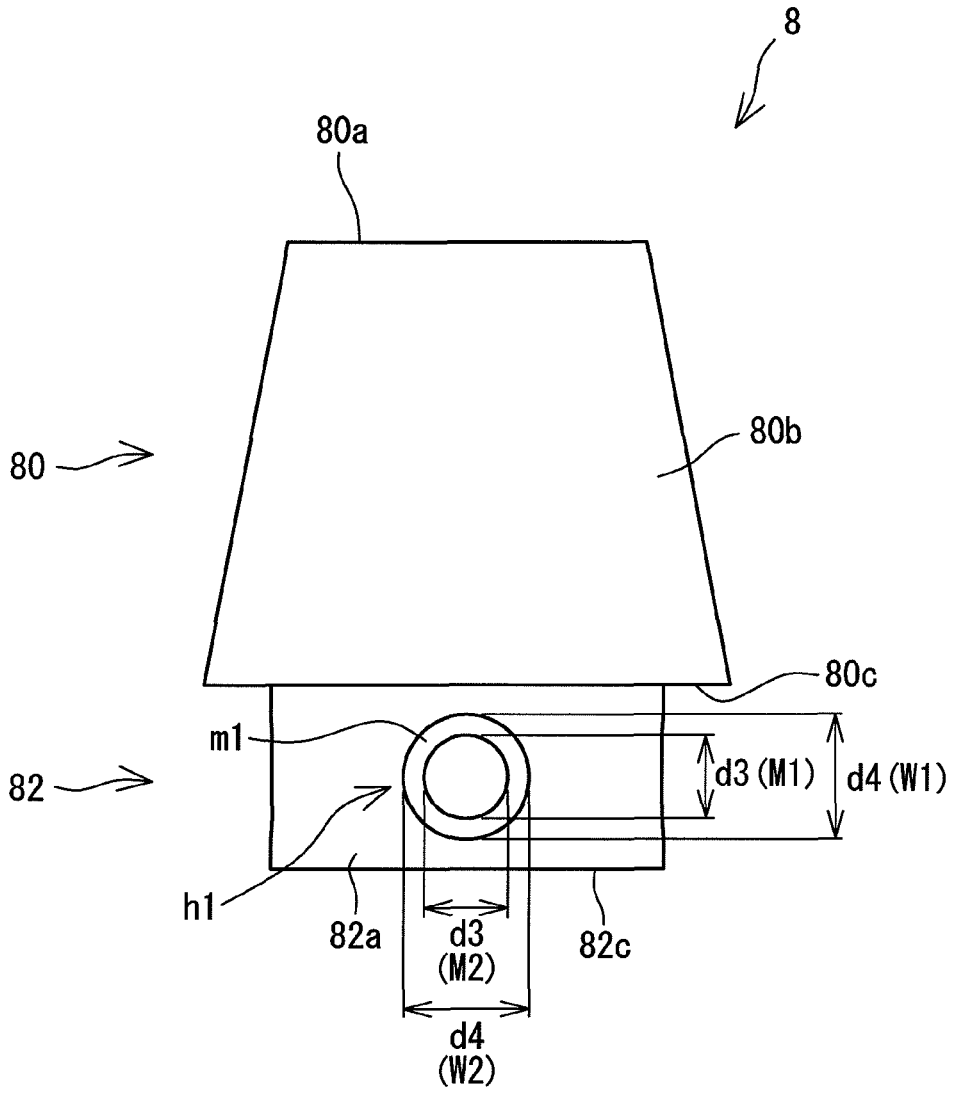
FIG. 5 is a side view of the ferrule.
Figure 6:
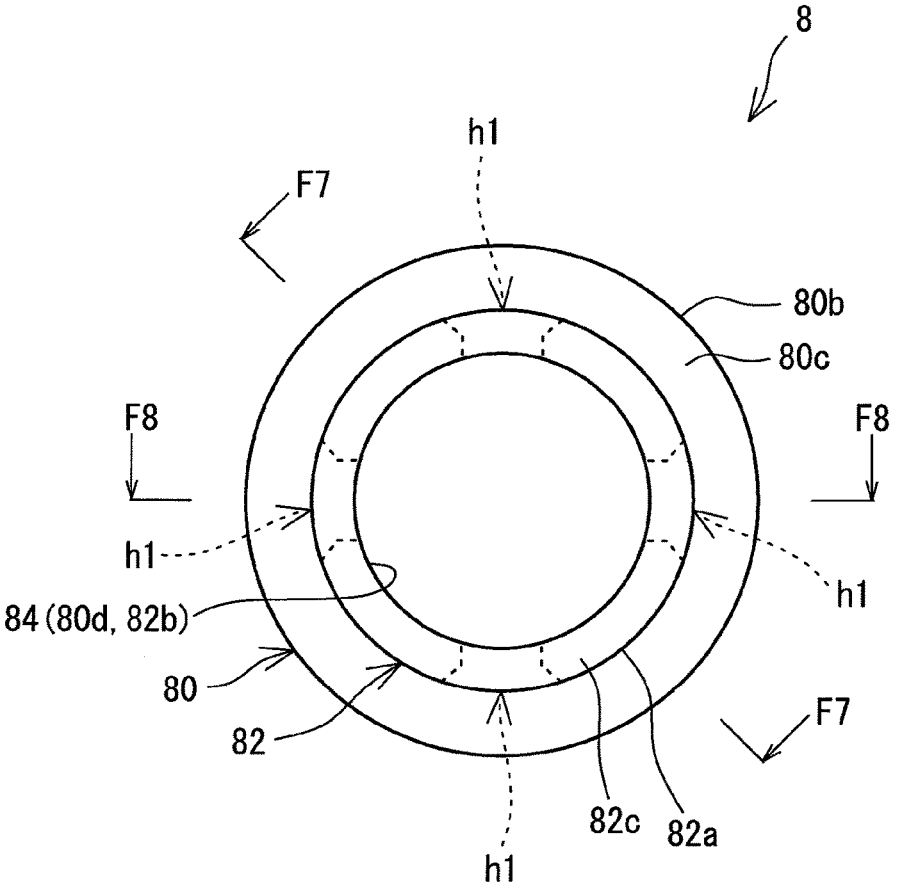
FIG. 6 is a bottom view of the ferrule.
Figure 7:
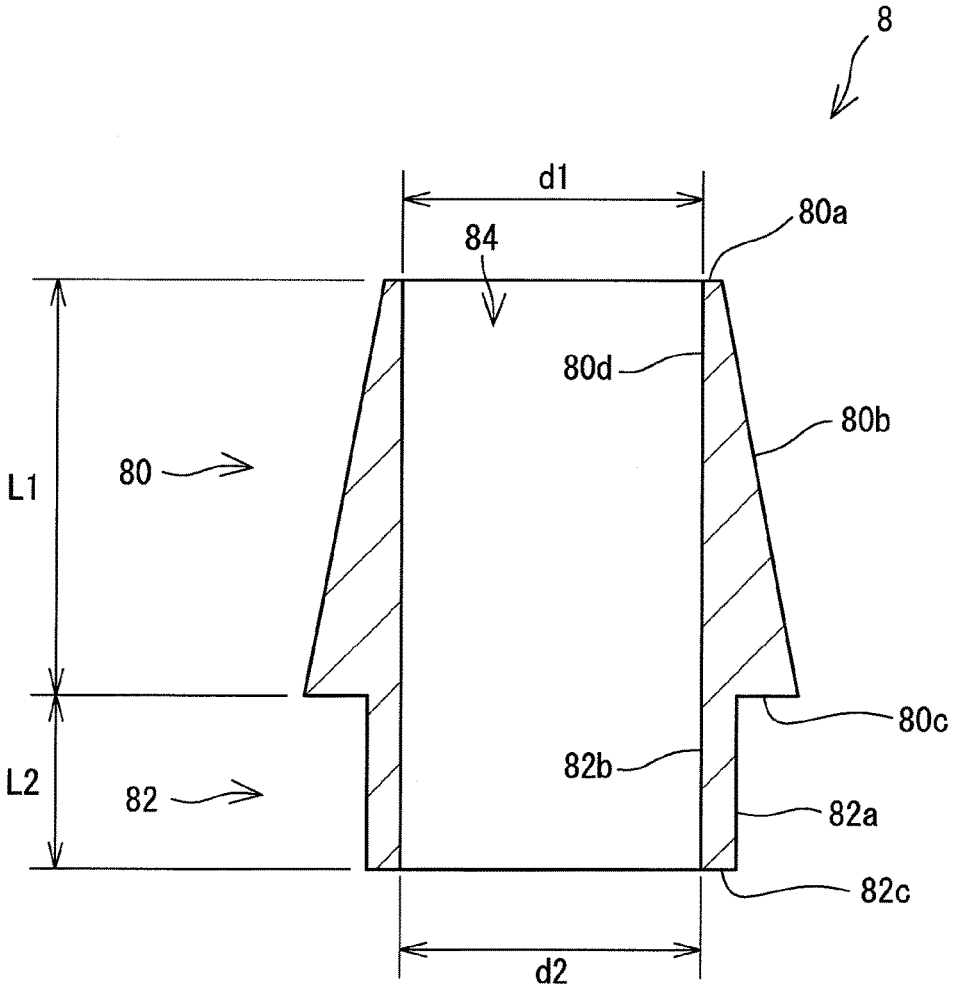
FIG. 7 is a sectional view taken along line F7-F7 of FIG. 6.
Figure 8:
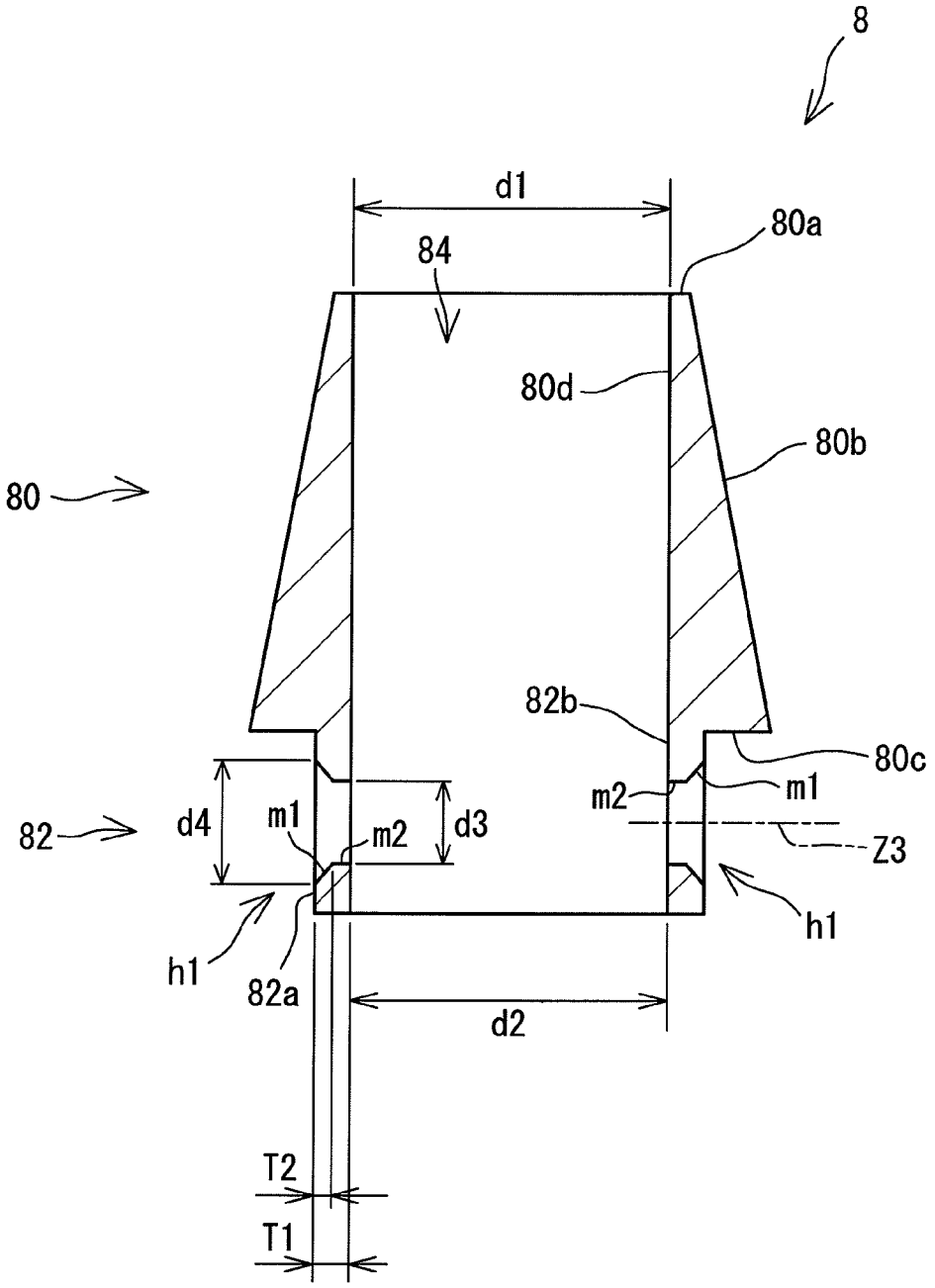
FIG. 8 is a sectional view taken along line F8-F8 of FIG. 6.

FIG. 4 is a perspective view of the ferrule 8. FIG. 5 is a side view of the ferrule 8. FIG. 6 is a bottom view of the ferrule 8. FIG. 7 is a sectional view taken along line F7-F7 in FIG. 6. FIG. 8 is a sectional view taken along line F8-F8 in FIG. 6.

The ferrule 8 includes a shaft hole 84. In the club 2, the shaft 6 penetrates the shaft hole 84 (see FIG. 2 and FIG. 3).

As shown in FIG. 7 and FIG. 8, the shaft hole 84 has an upper-end inner diameter d1 and a lower-end inner diameter d2. The upper-end inner diameter d1 is greater than the lower-end inner diameter d2. Although not shown in the drawings, the inner diameter of the shaft hole 84 is gradually decreased toward the lower side. Of the shaft 6, an outer diameter of a portion which is inserted to the shaft hole 84 is represented by ds, and the upper-end inner diameter d1 is greater than the shaft outer diameter ds. This facilitates the insertion of the shaft 6. On the other hand, the lower-end inner diameter d2 is smaller than the shaft outer diameter ds. This contributes to the fixation of the ferrule 8 to the shaft 6. A difference (d1−ds) is preferably greater than or equal to 0.1 mm and less than or equal to 0.3 mm. A difference (ds−d2) is preferably greater than or equal to 0.1 mm and less than or equal to 0.3 mm.

The upper part 80 of the ferrule 8 includes an upper end surface 80*a*, a side surface 80*b*, a lower end surface 80*c*, and an inner circumferential surface 80*d*. The inner circumferential surface 80*d* is a part of the inner surface of the shaft hole 84. The lower end surface 80*c* is located on a boundary between the upper part 80 and the lower part 82.

The upper end surface 80*a* extends along a direction perpendicular to the ferrule axis line Z1. In other words, the upper end surface 80*a* extends along the radial direction. The upper end surface 80*a* may be inclined with respect to the direction perpendicular to the ferrule axis line Z1. For example, the upper end surface 80*a* may be a conically protruded surface which is protruded toward the upper side as going to an inner side in the radial direction.

The side surface 80*b* extends from an outer edge of the upper end surface 80*a* to an outer edge of the lower end surface 80*c*. The side surface 80*b* is a conically protruded surface. The diameter of the side surface 80*b* is decreased toward the upper side.

In the club 2, the upper part 80 is exposed to the outside. In the club 2, the upper end surface 80*a* and the side surface 80*b* are exposed. In the club 2, the lower end surface 80*c* is not exposed. The lower end surface 80*c* abuts on the end surface 16*a* of the hosel 16 (see FIG. 2 and FIG. 3).

A chamfered portion may be provided on an edge at the inner side of the end surface 16*a*.

The lower part 82 of the ferrule 8 has a cylindrical shape as a whole. The lower part 82 extends toward the lower side from the lower end surface 80*c* of the upper part 80. The lower part 82 includes the outer surface 82*a*, the inner surface 82*b*, a lower end surface 82*c*, and the through hole h1. The inner surface 82*b* is a part of the inner surface of the shaft hole 84. The inner surface 82*b* is the inner circumferential surface of the lower part 82. The outer surface 82*a* is the outer circumferential surface of the lower part 82.

An adhesive is not used in the insertion of the shaft 6 to the ferrule 8. Therefore, an adhesive layer is not present between the shaft 6 and the ferrule 8. An adhesive layer is not present between the outer surface 6*a* of the shaft 6 and the inner surface 82*b* of the lower part 82. An adhesive layer is not present between the outer surface 6*a* of the shaft 6 and the inner circumferential surface 80*d* of the upper part 80.

As described above, the through hole h1 penetrates the lower part 82. The through hole h1 penetrates the lower part 82 in the radial direction. The through hole h1 extends from the outer surface 82*a* to the inner surface 82*b*.

The lower part 82 includes a plurality of through holes h1. In the present embodiment, four through holes h1 are provided. As shown in FIG. 6, the through holes h1 are provided at a plurality of (four) positions in the circumferential direction. The through holes h1 are arranged at equal intervals in the circumferential direction. In the present embodiment, the through holes h1 are arranged at 90-degree intervals in the circumferential direction.

The through hole h1 has a chamfered portion m1. The chamfered portion m1 is provided on the outer surface 82*a* side of the lower part 82. The chamfered portion m1 forms a conically protruded surface. A hole area of the chamfered portion m1 is increased toward an outer side in the radial direction. The hole area of the chamfered portion m1 is increased as approaching the inner surface of the shaft-insertion hole 30 (inner surface of the first portion 32).

In the present application, the hole area means a sectional area of the through hole h1. The sectional area is a sectional area in a plane perpendicular to a center line Z3 (see FIG. 8) of the through hole h1.

The through hole h1 includes a hole body portion m2. The inner diameter of the hole body portion m2 is constant. The hole area of the hole body portion m2 is constant. The hole body, portion m2 is a circular hole. The hole body portion m2 extends between the inner surface 82*b* and the chamfered portion m1. The chamfered portion m1 extends between the hole body portion m2 and the outer surface 82*a*.

[Effect of the Through Hole h1 Having the Chamfered Portion m1]

It has been found that the through hole h1 effectively suppresses the movement of the ferrule 8 with respect to the shaft 6.

An adhesive can be used in order to prevent the ferrule floating. The movement of the ferrule 8 with respect to the shaft 6 is suppressed by adhering the ferrule 8 to the shaft 6 with the adhesive. The movement is suppressed also by adhering the ferrule 8 to the shaft-insertion hole 30 with the adhesive. It has been found, however, that merely using an adhesive cannot achieve a sufficient ferrule fixation effect, and results in large variations between individuals.

It has been found that, by providing the through hole h1 on the ferrule lower part 82 and by providing the chamfered portion m1 on the through hole h1, the ferrule fixation effect brought by the adhesive is enhanced, and the variations between individuals are reduced to attain the effect consistently.

In the process of attaching the ferrule 8, the shaft 6 is first inserted to the shaft hole 84 of the ferrule 8 (first step). By the insertion, the ferrule 8 is disposed at a predetermined position on the shaft 6. Next, an adhesive is applied to a tip end portion of the ferrule-attached shaft, and the tip end portion is inserted to the shaft-insertion hole 30 (second step). The tip end portion means a portion on the tip end side with respect to the ferrule 8. The second step is essential as an assembling process of a golf club. This is because the second step is a process for adhering the head to the shaft. In the case of a club including a sleeve, the second step corresponds to a step of adhering the sleeve to the shaft.

Conventionally, an adhesive is applied between the ferrule 8 and the shaft 6 in the first step in order to adhere the ferrule 8 to the shaft 6. That is, the adhesive is applied to the tip end portion of the shaft 6, or the inner surface of the ferrule 8 before the insertion of the shaft 6 into the ferrule 8. In this way, in addition to the procedure of applying the adhesive, a procedure of removing excess adhesive after the insertion of the shaft is required. Furthermore, a period of time for hardening the adhesive is needed. The procedure and the period of time reduce productivity in assembling the golf club.

It has been found that the ferrule 8 makes it possible to attain a high ferrule fixation effect without using an adhesive in the first step. That is, it has been found that a high ferrule fixation effect can be attained by only using an adhesive in the second step. The adhesive used in the second step is required for adhering the head 4 to the shaft 6. That is, the adhesive in the second step is necessary for assembling the club regardless of the fixation of the ferrule 8. The adhesive is used only in the second step, thereby enhancing the ferrule fixation effect without changing the normal assembling process of a club. Therefore, the ferrule is securely fixed and the productivity in assembling the golf club does not deteriorate.

Although not shown in FIG. 3, the adhesive has entered into the inside of the through hole h1. In the second step, the adhesive enters into the through hole h1. As described above, the adhesive entered into the inside of the through hole h1 is also referred to as the intra-hole adhesive. The intra-hole adhesive is adhered to the shaft-insertion hole 30 (first portion 32). Furthermore, the intra-hole adhesive is also adhered to the shaft 6. The intra-hole adhesive enhances the ferrule fixation effect.

When the intra-hole adhesive penetrates the through hole to adhere the shaft-insertion hole to the shaft, an anchor effect is generated, thus enhancing the ferrule fixation effect. Ideally, the through hole is completely filled with the adhesive. However, it is considered that such a complete filling cannot be easily made. One of the reasons is the presence of air inside the through hole. In the second step, if the air is properly discharged, the adhesive easily flows into the though hole. However, in the state of a club, the through hole h1 is a closed space (see FIG. 3), and thus the air might not be properly discharged in the second step. In this case, the adhesive is less likely to flow into the through hole.

In the present embodiment, the chamfered portion m1 is provided. The effects brought by the chamfered portion m1 are proved in Examples described later. From the results, it is considered that the chamfered portion m1 contributes to the flowing of the adhesive into the inside of the through hole h1. It is considered that the chamfered portion m1 facilitates the flowing of the adhesive into the through hole h1, and also facilitates the discharging of the air from the inside of the through hole h1.

A double-pointed arrow d3 in FIG. 8 shows a minimum hole diameter of the through hole h1. In the present embodiment, the minimum hole diameter d3 is the hole diameter of the hole body portion m2. If the hole diameter d3 is excessively large, the strength of the lower part 82 deteriorates and the anchor effect can be reduced. In this respect, the hole diameter d3 is preferably less than or equal to 4 mm, and more preferably less than or equal to 3.5 mm. If the hole diameter d3 is excessively small, the intra-hole adhesive becomes thin to reduce the adhesion effect. In this respect, the hole diameter d3 is preferably greater than or equal to 1 mm, and more preferably greater than or equal to 2 mm.

In the through hole h1, a minimum hole area is defined. The minimum hole area of the through hole h1 is a hole area of the hole body portion m2. If the minimum hole area is excessively large, the strength of the lower part 82 deteriorates and the anchor effect can be reduced. In this respect, the minimum hole area is preferably less than or equal to 12 $mm^2$, and more preferably less than or equal to 10 $mm^2$. If the minimum hole area is excessively small, the intra-hole adhesive becomes thin to reduce the adhesion effect. In this respect, the minimum hole area is preferably greater than or equal to 1 $mm^2$, and more preferably greater than or equal to 3 $mm^2$.

A double-pointed arrow d4 in FIG. 5 and FIG. 8 shows a maximum hole diameter of the through hole h1. In the present embodiment, the maximum hole diameter d4 is the maximum hole diameter of the chamfered portion m1. If the hole diameter d4 is excessively large, a filling ratio of the adhesive in the through hole h1 is decreased and the anchor effect can be reduced. In this respect a ratio (d4/d3) is preferably less than or equal to 3, more preferably less than or equal to 2, and still more preferably less than or equal to 1.5. In light of facilitating the flowing of the adhesive into the through hole h1 and the discharging of air from the through hole h1, the ratio (d4/d3) is preferably greater than or equal to 1.1, more preferably greater than or equal to 1.2, and still more preferably greater than or equal to 1.3.

A double-pointed arrow T1 in FIG. 8 shows a thickness (mm) of the lower part 82. The thickness T1 is measured along the radial direction. A double-pointed arrow T2 in FIG. 8 shows a depth (mm) of the chamfered portion m1. The depth T2 is measured along the radial direction.

In light of facilitating the flowing of the adhesive into the through hole h1 and the discharging of air from the through hole h1, T2/T1 is preferably greater than or equal to 0.1, more preferably greater than or equal to 0.2, and still more preferably greater than or equal to 0.3. In light of the breaking strength of the lower part 82, T2/T1 is preferably less than or equal to 0.7, more preferably less than or equal to 0.6, and still more preferably less than or equal to 0.5.

A double-pointed arrow W1 in FIG. 5 shows a maximum axial-direction width of the chamfered portion m1. A double-pointed arrow W2 in FIG. 5 shows a maximum circumferential-direction width of the chamfered portion m1. In the present embodiment, the width W1 is equal to the width W2 (W1=W2=d4). W1 may differ from W2. For example, the boundary line between the chamfered portion m1 and the outer surface 82*a* may have an elliptical shape. If the width W2 is excessively large, the breaking strength of the lower part 82 against a force toward the axial-direction lower side tends to be reduced. If this strength is small, the anchor effect brought by the intra-hole adhesive can be reduced by breaking of the lower part 82. In this respect, the width W2 is preferably less than or equal to the width W1. In other words, it is preferable that the width W2 is the same as the width W1, or smaller than the width W1.

A double-pointed arrow M1 in FIG. 5 shows a minimum axial-direction width of the through hole h1. A double-pointed arrow M2 in FIG. 5 shows a minimum circumferential-direction width of the through hole h1. In the present embodiment, the width M1 is equal to the width M2 (M1=M2=d3). M1 may differ from M2. For example, the hole body portion m2 has a hole shape of elliptical. If the width M2 is excessively large, the breaking strength of the lower part 82 against the force toward the axial-direction lower side tends to be reduced. If this strength is small, the anchor effect brought by the intra-hole adhesive can be reduced by breaking of the lower part 82. In this respect, the width M2 is preferably less than or equal to the width M1. In other words, it is preferable that the width M2 is the same as the width M1, or smaller than the width M1.

A double-pointed arrow L1 in FIG. 7 shows an axial-direction length of the upper part 80. In light of ensuring appearance, an excessively small length L1 is not preferable. However, if the length L1 is large, the shaft hole 84 is elongated, and the amount of bending of the shaft 6 inside the shaft hole 84 is increased. As a result, the ferrule floating tends to occur.

The through hole h1 enhances a shaft fixation effect. For this reason, even when the length L1 is increased, the ferrule floating is effectively suppressed. In this respect, the length L1 is preferably greater than or equal to 5 mm, more preferably greater than or equal to 7 mm, and still more preferably greater than or equal to 9 mm. In addition, the length L1 is preferably greater than a length L2 (described later) of the lower part 82. In light of appearance, the length L1 is preferably less than or equal to 30 mm, and more preferably less than or equal to 25 mm.

A double-pointed arrow L2 in FIG. 7 shows an axial-direction length of the lower part 82. In light of the shaft fixation effect, the length L2 is preferably greater than or equal to 3 mm, more preferably greater than or equal to 4 mm, and still more preferably greater than or equal to 5 mm. In light of ease in production of the ferrule, the length L2 is preferably less than or equal to 15 mm, and more preferably less than or equal to 10 mm.

In light of enhancing the anchor effect while enhancing the breaking strength of the lower part 82, it is preferable that the through hole h1 having a small hole area is provided at a plurality of positions in the circumferential direction. In this respect, the through hole h1 is preferably provided at two or more positions in the circumferential direction, and more preferably provided at three or more positions in the circumferential direction. If the number of the through holes h1 in the lower part 82 is excessively large, the breaking strength of the lower part 82 deteriorates. In this respect, the through hole h1 is preferably provided at six or less positions in the circumferential direction, and more preferably provided at five or less positions in the circumferential direction. The number of the through holes h1 is preferably 2 or greater and 6 or less, more preferably 3 or greater and 6 or less, and still more preferably 3 or greater and 5 or less.

The material of the ferrule is not limited. In light of elastic deformation caused by the insertion of the shaft, the material is preferably a resin. Examples of the preferable material of the ferrule include cellulose acetate, cellulose nitrate, an ABS resin, and polypropylene. In light of processability in the finishing step of assembling the golf club, cellulose acetate or cellulose nitrate is more preferable, and cellulose acetate is still more preferable.

The adhesive for fixing the ferrule is not limited. Examples of utilizable adhesives include an epoxy-based adhesive, an acrylic-based adhesive and a urethane-based adhesive. In light of adhesive strength, the epoxy-based adhesive is preferable. The adhesive may be a one-component hardenable adhesive, or may be a two-component hardenable adhesive.

EXAMPLES

Hereinafter, the effects of examples will be clarified. However, the present disclosure should not be interpreted in a limited way based on the description of the examples.

Example 1

Figure 9:
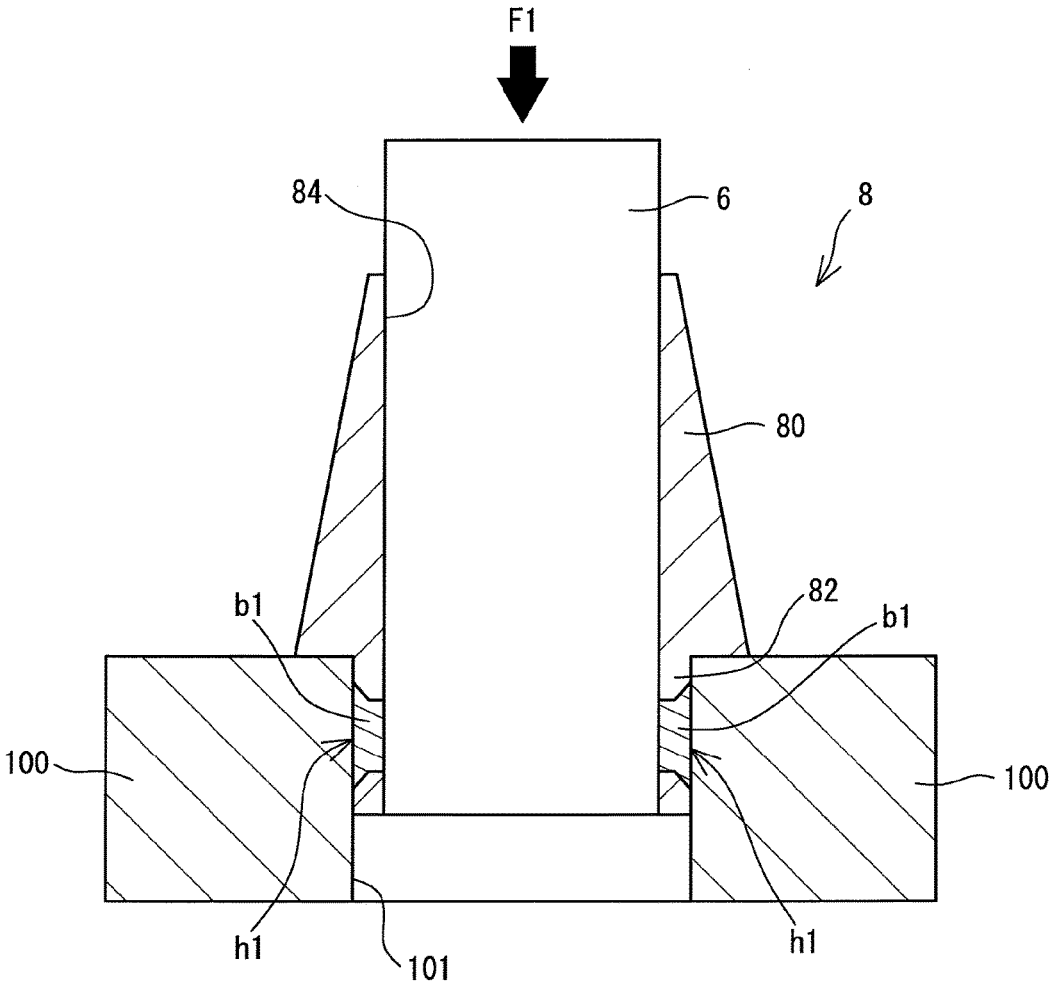
FIG. 9 is a sectional view of Example 1.

The above-described ferrule 8 was used to produce a test sample of Example 1. The sectional view of Example 1 is shown in FIG. 9.

First, the ferrule 8 was produced by injection forming. The material of the ferrule was cellulose acetate. The length L1 of the upper part 80 was 11 mm, the length L2 of the lower part 82 was 5 mm, the maximum outer diameter of the upper part 80 was 13.8 mm, the upper-end inner diameter d1 was 9.1 mm, the lower-end inner diameter d2 was 8.8 mm, and the radial-direction thickness at the lower end surface of the lower part 82 was 1 mm. Each of the four through holes h1 had a hole diameter d3 of 2 mm, and a hole diameter d4 of 3 mm. The shaft 6 was inserted to the ferrule 8. An adhesive was not used in the insertion. The outer diameter of the shaft 6 was 9.0 mm, and was greater than the inner diameter d2. Thus, the shaft 6 was press fitted into the shaft hole 84 of the ferrule 8. The shaft 6 was cut to be shorten for facilitating the test. That is, the shaft 6 was cut so as to have a length slightly longer than the full length of the ferrule 8.

Next, a jig 100 was prepared. The jig 100 was a ring-shaped member including a central through hole 101. The material of the jig 100 was stainless steel. The jig 100 was a substitute of a hosel part of a head. The inner diameter of the central through hole 101 was the same as the outer diameter of the lower part 82.

In the ferrule 8 to which the shaft 6 was inserted, an adhesive was applied to the outer surface 82*a* of the lower part 82, and then the lower part 82 was inserted to the central through hole 101. This was left standing for a predetermined period of time for the purpose of curing the adhesive, thereby obtaining the test sample of Example 1.

FIG. 9 shows the sectional view of the obtained Example 1. In FIG. 9, the through holes h1 are completely filled with the adhesives b1. This is an ideal state. An actual degree of the filling can be inferred based on results of evaluations.

Comparative Example 1

A ferrule of Comparative Example 1 was obtained in the same manner as the ferrule 8 of Example 1 except that the lower part of the ferrule had a simple cylindrical shape that did not include a through hole or a recess part. In Comparative Example 1, an adhesive was applied also between the ferrule and the shaft. That is, the adhesive was applied to the outer surface of the shaft, and then the shaft was inserted to the ferrule, so that an adhesive layer was present between the ferrule and the shaft. A test sample of Comparative Example 1 was obtained in the same manner as in Example 1 except for the above-described matters.

Comparative Example 2

Figure 11:
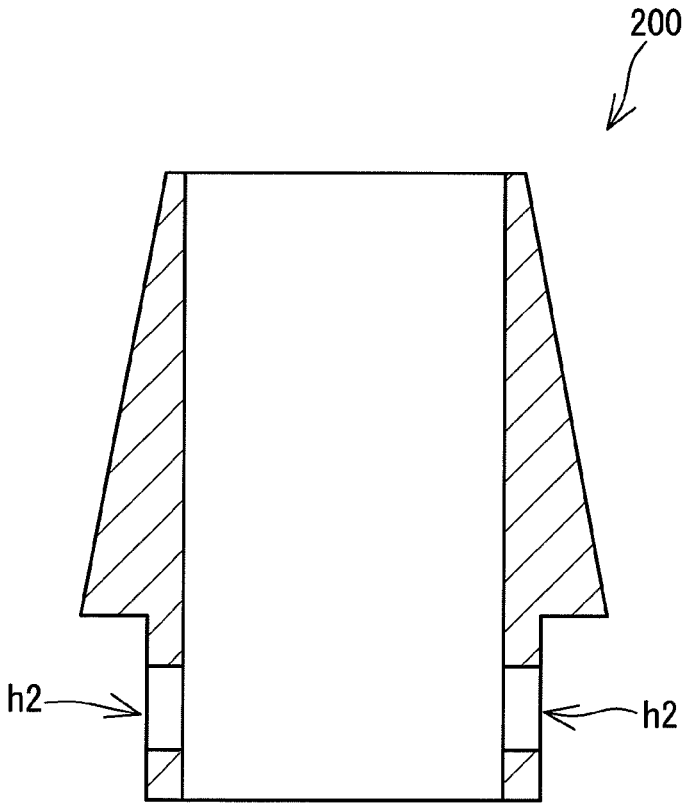
FIG. 11 is a sectional view of a ferrule according to Comparative Example 2.

FIG. 11 shows a sectional view of a ferrule 200 according to Comparative Example 2. The lower part of the ferrule 200 had through holes h2. Each of the through holes h2 did not have a chamfered portion. The hole diameter of the through hole h2 was the same as the hole diameter d3 of the through hole h1 in Example 1. The ferrule 200 was the same as the ferrule 8 of Example 1 except that the through holes h1 were changed to the through holes h2. A test sample of Comparative Example 2 was obtained in the same manner as in Example 1 except that the ferrule 200 was used.

Comparative Example 3

Figure 12:
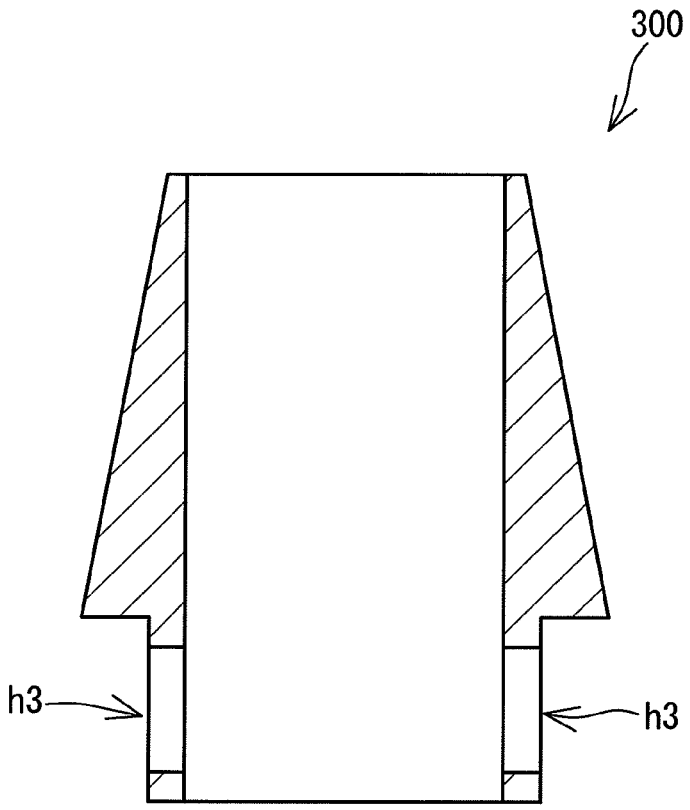
FIG. 12 is a sectional view of a ferrule according to Comparative Example 3.

FIG. 12 shows a sectional view of a ferrule 300 according to Comparative Example 3. The lower part of the ferrule 300 had through holes h3. Each of the through holes h3 did not have a chamfered portion. The hole diameter of the through hole h3 was the same as the maximum hole diameter d4 of the through hole h1 in Example 1. The ferrule 300 was the same as the ferrule 8 of Example 1 except that the through holes h1 were changed to the through holes h3. A test sample of Comparative Example 3 was obtained in the same manner as in Example 1 except that the ferrule 300 was used.

Comparative Example 4

Figure 13:
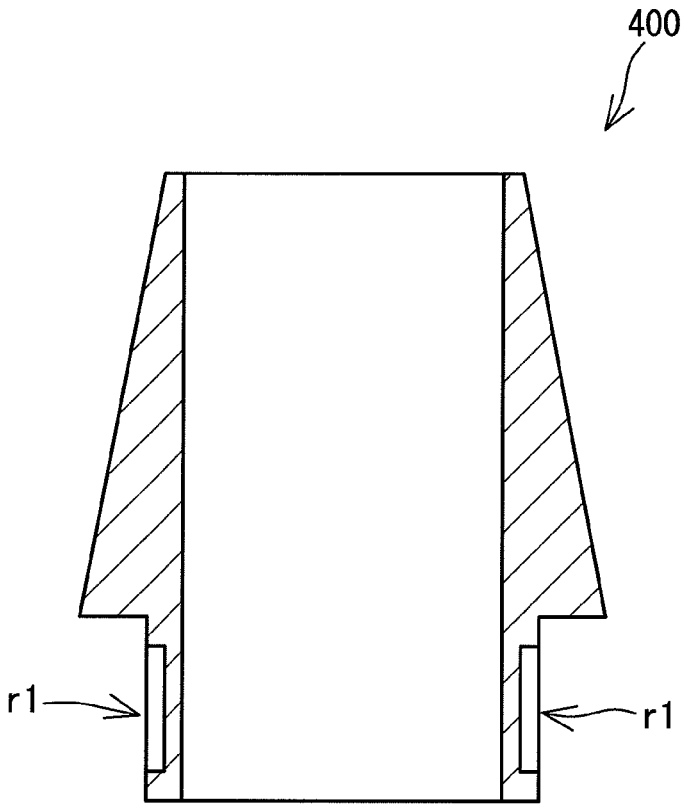
FIG. 13 is a sectional view of a ferrule according to Comparative Example 4.

FIG. 13 shows a sectional view of a ferrule 400 according to Comparative Example 4. The lower part of the ferrule 400 had recess parts r1. Each of the recess parts r1 was a circular-shaped recess part and did not penetrate the lower part of the ferrule. The hole diameter of the recess part r1 was the same as the maximum hole diameter d4 of the through hole h1 in Example 1. The ferrule 400 was the same as the ferrule 8 of Example 1 except that the through holes h1 were changed to the recess parts r1. A test sample of Comparative Example 4 was obtained in the same manner as in Example 1 except that the ferrule 400 was used.

[Evaluation Method]

A ferrule-shaft adhesive strength and a ferrule-jig adhesive strength were evaluated by the following methods. The latter, the ferrule-jig adhesive strength shows the adhesive strength between the ferrule and the shaft-insertion hole of the head.

[Ferrule-Shaft Adhesive Strength]

FIG. 9 shows a method for measuring the ferrule-shaft adhesive strength. As a testing device, "Intesco (load cell 2 tons)" produced by Intesco Co., Ltd. was used. A force F1 was applied on the upper end surface of the shaft 6 from the upper side toward the lower side in a state where the jig 100 was fixed. The force F1 was gradually increased, and the force F1 at a moment when the shaft 6 was moved with respect to the ferrule 8 was measured. The measured value is the ferrule-shaft adhesive strength. The unit of the measured value is kgf.

[Ferrule-Jig Adhesive Strength]

Figure 10:
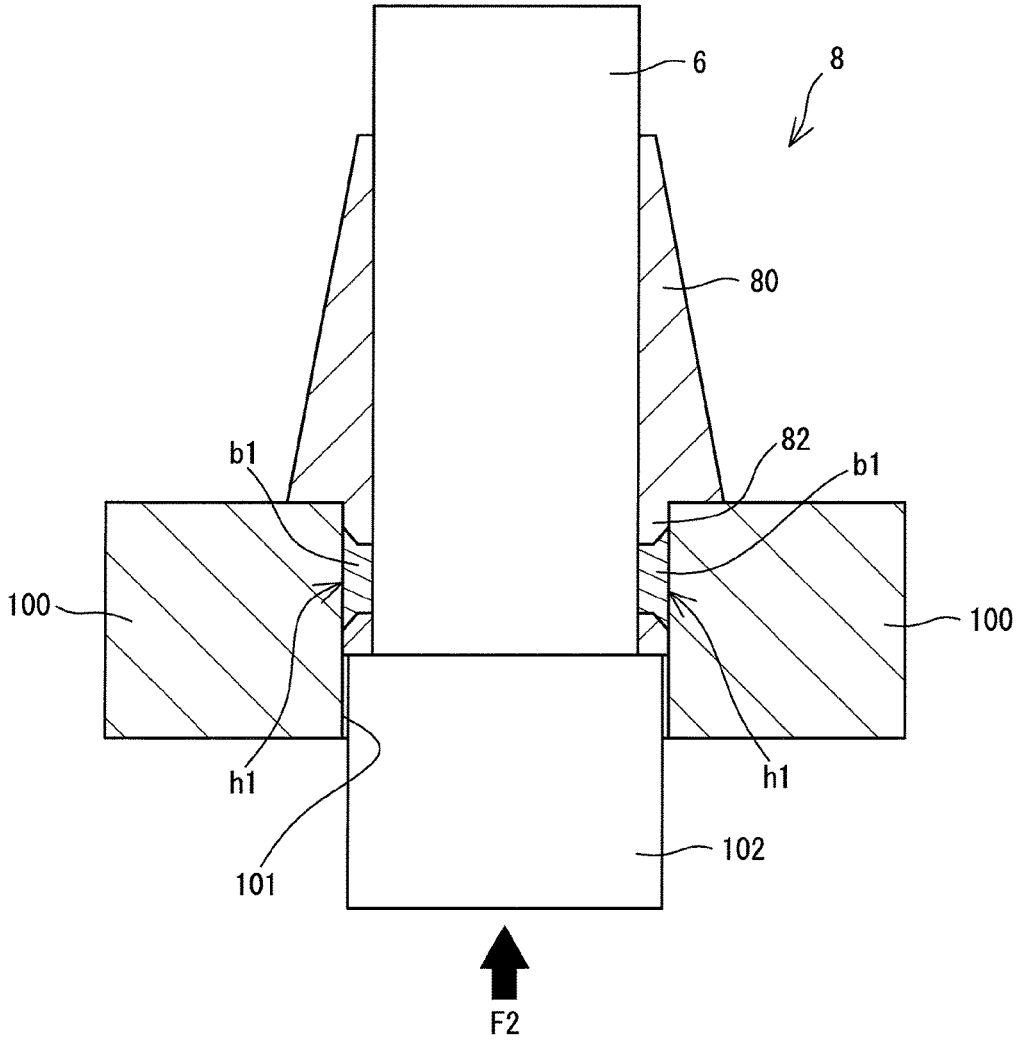
FIG. 10 is a sectional view showing a method for measuring a ferrule-jig adhesive strength.

FIG. 10 shows a method for measuring the ferrule-jig adhesive strength. The ferrule-jig adhesive strength was measured by using the same testing device as the ferrule-shaft adhesive strength. A pressing cylinder 102 having an outer diameter smaller than the inner diameter of the central through hole 101 was prepared, and the pressing cylinder 102 was abutted on the lower end surface of the ferrule 8. A force F2 was applied on the pressing cylinder 102 from the lower side toward the upper side in the state where the jig 100 was fixed. The force F2 was gradually increased, and the force F2 at a moment when the ferrule 8 was moved with respect to the jig 100 was measured. The measured value is the ferrule-jig adhesive strength. The unit of the measured value is kgf.

Results of evaluations are shown below.

Evaluation Result 1: Comparison Between Example 1 and Comparative Example 1

Table 1 shows evaluation results of Example 1 and Comparative Example 1. As to Example 1 and Comparative Example 1, eight samples for each were produced. Table 1 shows measured values of respective test pieces.

TABLE 1

| | Ferrule-Shaft Adhesive Strength | | Ferrule-Jig Adhesive Strength | |
|---|---|---|---|---|
| | Example 1 | Comparative Example 1 | Example 1 | Comparative Example 1 |
| 1 | 62.7 | 66.6 | 158.9 | 35.6 |
| 2 | 61.2 | 61.6 | 137.8 | 65.3 |
| 3 | 76.6 | 55.9 | 148.9 | 31.3 |
| 4 | 63.8 | 32.6 | 145.6 | 115.1 |
| 5 | 62.1 | 63.6 | 114.2 | 44.2 |
| 6 | 64.9 | 60.5 | 142.9 | 54.9 |
| 7 | 65.3 | 85.3 | 153.0 | 51.8 |
| 8 | 63.7 | 64.8 | 113.7 | 17.0 |
| Average | 65.0 | 61.4 | 139.4 | 51.9 |
| Standard Deviation | 4.86 | 14.53 | 16.89 | 29.66 |
| Maximum Value | 76.6 | 85.3 | 158.9 | 115.1 |
| Minimum Value | 61.2 | 32.6 | 113.7 | 17.0 |
| (Maximum Value) − (Minimum Value) | 15.4 | 52.8 | 45.1 | 98.2 |

Table 1 Specifications and Results of Evaluations of Example 1 and Comparative Example 1

As shown in Table 1, great differences can be seen between respective measured values of Example 1 and Comparative Example 1. Not only differences in average values but also great differences in variations of measured values are observed. Note that an adhesive was applied also between the shaft and the ferrule in the production of Comparative Example 1, whereas the adhesive was not applied between the shaft and the ferrule in Example 1, as described above. Although the adhesive was applied also between the shaft and the ferrule in Comparative Example 1, the evaluation results of Comparative Example 1 are clearly inferior to those of Example 1.

Evaluation Result 2: Comparison Between Example 1 and Comparative Examples 2 to 4

50 samples were produced for each of Example 1 and Comparative Examples 2 to 4. For each of the samples, the ferrule-shaft adhesive strength and the ferrule-jig adhesive strength were evaluated. Results of the evaluations of Example 1 and Comparative Examples 2 to 4 were as follows.

Example 1

Ferrule-Shaft Adhesive Strength
Maximum value: 80.1 (kgf)
Minimum value: 61.2 (kgf)
The number of samples having an evaluation value of less than or equal to 50 kgf: 0
Ferrule-Jig Adhesive Strength
Maximum value: 162.3 (kgf)
Minimum value: 113.1 (kgf)
The number of samples having an evaluation value of less than or equal to 100 kgf: 0

Comparative Example 2

Ferrule-Shaft Adhesive Strength
Maximum value: 78.2 (kgf)
Minimum value: 36.4 (kgf)
The number of samples having an evaluation value of less than or equal to 50 kgf: 13
Ferrule-Jig Adhesive Strength
Maximum value: 160.1 (kgf)
Minimum value: 110.5 (kgf)
The number of samples having an evaluation value of less than or equal to 100 kgf: 0

Comparative Example 3

Ferrule-Shaft Adhesive Strength
Maximum value: 79.5 (kgf)
Minimum value: 42.3 (kgf)
The number of samples having an evaluation value of less than or equal to 50 kgf: 7
Ferrule-Jig Adhesive Strength
Maximum value: 161.3 (kgf)
Minimum value: 90.1 (kgf)
The number of samples having an evaluation value of less than or equal to 100 kgf: 5

Comparative Example 4

Ferrule-Shaft Adhesive Strength
Maximum value: 79.1 (kgf)
Minimum value: 34.5 (kgf)
The number of samples having an evaluation value of less than or equal to 50 kgf: 9
Ferrule-Jig Adhesive Strength
Maximum value: 142.2 (kgf)
Minimum value: 96.1 (kgf)
The number of samples having an evaluation value of less than or equal to 100 kgf: 3

Thus, variations are large in Comparative Examples 2 to 4 as compared with Example 1, and samples having an evaluation value of less than or equal to a predetermined value are present in Comparative Examples 2 to 4. The cause is considered to be variations in flowing of the adhesive into the through hole for Comparative Examples 2 and 3. Meanwhile, for Comparative Example 4, the cause is considered that the anchor effect brought by the penetration of the intra-hole adhesive could not be obtained. These differences in the evaluation results show that the rates of defectives in which the ferrule floating occurs can significantly differ in mass production of thousands of more clubs, for example.

The ferrule described above is applicable to all golf clubs such as a wood type golf club, a hybrid type golf club, an iron type golf club, and a putter type golf club.

The above descriptions are merely illustrative examples, and various modifications can be made.

What is claimed is:

1. A golf club comprising:
a shaft-insertion hole;
a shaft inserted to the shaft-insertion hole and adhered to the shaft-insertion hole by an adhesive; and
a ferrule attached to the shaft, wherein
the ferrule includes an upper part exposed to an outside, and a lower part located between the shaft-insertion hole and the shaft,
the lower part includes at least one through hole, and
the through hole includes a chamfered portion on an outer surface side of the lower part.

2. The golf club according to claim 1, wherein
the at least one through hole of the lower part comprises a plurality of through holes, and
the through holes are provided at respective three or more positions in a circumferential direction of the lower part.

3. The golf club according to claim 1, wherein
the through hole has a minimum hole area of greater than or equal to 3 $mm^2$ and less than or equal to 12 $mm^2$.

4. The golf club according to claim 1, wherein
the through hole has a minimum axial-direction width M1 and a minimum circumferential-direction width M2, and
the minimum circumferential-direction width M2 is equal to the minimum axial-direction width M1, or is smaller than the minimum axial-direction width M1.

5. The golf club according to claim 1, wherein
an intra-hole adhesive that is hardened is present inside the though hole.

6. The golf club according to claim 5, wherein
the intra-hole adhesive penetrates the lower part.

7. The golf club according to claim 5, wherein
an adhesive layer is not present between an outer surface of the shaft and an inner surface of the lower part.

8. The golf club according to claim 5, wherein
an adhesive layer is not present between an outer surface of the shaft and an inner circumferential surface of the upper part.

9. The golf club according to claim 1, wherein
when a thickness of the lower part is represented by T1, and a depth of the chamfered portion is represented by T2,
T2/T1 is greater than or equal to 0.1 and less than or equal to 0.7.

10. The golf club according to claim 1, wherein
the lower part has an axial-direction length of greater than or equal to 3 mm and less than or equal to 15 mm.

11. The golf club according to claim 1, wherein
the upper part has an axial-direction length of greater than or equal to 5 mm and less than or equal to 30 mm.

12. The golf club according to claim 1, wherein
when a minimum hole diameter of the through hole is represented by d3, and a maximum hole diameter of the through hole is represented by d4,
d4/d3 is greater than or equal to 1.1 and less than or equal to 3.

* * * * *